US009893469B2

(12) United States Patent
Tabata et al.

(10) Patent No.: US 9,893,469 B2
(45) Date of Patent: Feb. 13, 2018

(54) CONNECTOR DEVICE

(71) Applicant: JAPAN AVIATION ELECTRONICS INDUSTRY, LIMITED, Shibuya-ku, Tokyo (JP)

(72) Inventors: Yuya Tabata, Tokyo (JP); Akito Ishigaki, Tokyo (JP); Kiminobu Tabata, Tokyo (JP); Koki Igarashi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/488,542

(22) Filed: Apr. 17, 2017

(65) Prior Publication Data

US 2017/0331226 A1 Nov. 16, 2017

(30) Foreign Application Priority Data

May 12, 2016 (JP) ..... 2016-096347

(51) Int. Cl.
*H01R 13/641* (2006.01)
*H01R 24/00* (2011.01)
*H01R 13/633* (2006.01)

(52) U.S. Cl.
CPC ..... *H01R 13/641* (2013.01); *H01R 13/6335* (2013.01); *H01R 24/005* (2013.01)

(58) Field of Classification Search
CPC . H01R 13/641; H01R 13/6335; H01R 24/005
USPC ..... 439/670, 478, 489
See application file for complete search history.

(56) References Cited

U.S. PATENT DOCUMENTS 6,755,673 B2 6/2004 Fukushima et al.
7,438,570 B2 * 10/2008 Mori ..... H01R 13/62933 439/157
7,872,206 B2 * 1/2011 Matsunaga ..... H01H 9/085 200/335
9,048,045 B2 * 6/2015 Henmi ..... H01R 13/62933
9,325,112 B2 4/2016 Tabata et al.

FOREIGN PATENT DOCUMENTS

JP 2002343169 A 11/2002
JP 2013016427 A 1/2013
JP 2015050116 A 3/2015

* cited by examiner

*Primary Examiner* — Tulsidas C Patel
*Assistant Examiner* — Travis Chambers
(74) *Attorney, Agent, or Firm* — Holtz, Holtz & Volek PC

(57) ABSTRACT

A connector device comprises a connector and a mating connector. The connector comprises a housing formed with an axis portion and holding a power terminal and a detection terminal. The mating connector comprises a mating housing formed with a mating axis portion and holding a mating power terminal and a mating detection terminal. When the axis portion and the mating axis portion are combined, the connector is turnable from an opened position to a closed position via a predetermined position. When the connector is located at the opened position, the power terminal and the detection terminal are unconnected to the mating power terminal and the mating detection terminal, respectively. When the connector is turned to the predetermined position, the power terminal is connected to the mating power terminal. When the connector is turned to the closed position, the detection terminal is connected to the mating detection terminal.

13 Claims, 10 Drawing Sheets

CONNECTOR DEVICE

CROSS REFERENCE TO RELATED APPLICATIONS

This application is based on and claims priority under 35 U.S.C. § 119 to Japanese Patent Application No. JP2016-096347 filed May 12, 2016, the content of which is incorporated herein in its entirety by reference.

BACKGROUND OF THE INVENTION

This invention relates to a connector device and, in particular, relates to a connector device which is attached to an electric car or a hybrid car to transmit electric power supplied from a power system.

For example, this type of connector device is disclosed in JP 2002-343169A (Patent Document 1), the content of which is incorporated herein by reference.

Referring to FIG. 20, Patent Document 1 discloses a connector device 900 which comprises a connector 910 and a mating connector 950. The connector 910 comprises a housing 920, a lever 930 and a sub-connector 940. The lever 930 is attached to the housing 920 so as to be turnable relative to the housing 920. The lever is formed with a cam groove 935. The sub-connector 940 is held by the housing 920 so as to be movable relative to the housing 920 in an upper-lower direction (Z-direction). The mating connector 950 comprises a mating housing 960. The mating housing 960 is formed with a cam projection 965. In addition, the mating housing 960 is provided with a mating sub-connector 970 which is a part of the mating housing 960. When the lever 930 is turned under a state where the cam projection 965 is received in the cam groove 935, the connector 910 is moved relative to the mating connector 950 in the upper-lower direction. When the lever 930 is subsequently moved in a horizontal direction (X-direction), the sub-connector 940 is mated with the mating sub-connector 970.

According to Patent Document 1, when the connector 910 is assembled, the lever 930 needs to be attached to the housing 920 with high positional accuracy. If the lever 930 is improperly positioned relative to the housing 920, it is impossible to properly position the cam projection 965 of the mating housing 960 relative to the cam groove 935 of the lever 930 while properly positioning the housing 920 relative to the mating housing 960. As a result, the connector 100 cannot be properly mated with the mating connector 950.

SUMMARY OF THE INVENTION

It is therefore an object of the present invention to provide a connector device which comprises a connector and a mating connector properly mateable with each other.

An aspect of the present invention provides a connector device which comprises a connector and a mating connector which are mateable with each other. The connector comprises a housing, a power terminal and a detection terminal. The housing is formed with an axis portion. The power terminal and the detection terminal are held by the housing. The mating connector comprises a mating housing, a mating power terminal and a mating detection terminal. The mating housing is formed with a mating axis portion. One of the axis portion and the mating axis portion is a shaft, and a remaining one of the axis portion and the mating axis portion is a bearing. When the axis portion and the mating axis portion are combined with each other, the connector is turnable on the shaft relative to the mating connector between an opened position and a closed position. The mating power terminal and the mating detection terminal are held by the mating housing. When the connector is located between the opened position and the closed position, the connector is located upward of the mating connector in an upper-lower direction perpendicular to an axial direction of the shaft. When the connector is located at the opened position, the power terminal is unconnected to the mating power terminal, and the detection terminal is unconnected to the mating detection terminal. When the connector is located at a predetermined position between the opened position and the closed position, the power terminal is connected to the mating power terminal, and the detection terminal is unconnected to the mating detection terminal. When the connector is located at the closed position, the power terminal is connected to the mating power terminal, and the detection terminal is connected to the mating detection terminal.

The connector according to an aspect of the present invention does not comprise such a lever that is provided to the connector of Patent Document 1. Not the lever but the housing is provided with the axis portion, and the mating housing is provided with the mating axis portion. When the axis portion and the mating axis portion are combined with each other, the connector is attached to the mating connector so that the whole of the connector is turnable relative to the mating connector. According to the aspect of the present invention, the number of the components can be reduced, and the problem due to positional inaccuracy of the lever relative to the housing can be overcome.

An appreciation of the objectives of the present invention and a more complete understanding of its structure may be had by studying the following description of the preferred embodiment and by referring to the accompanying drawings.

Figure 1:
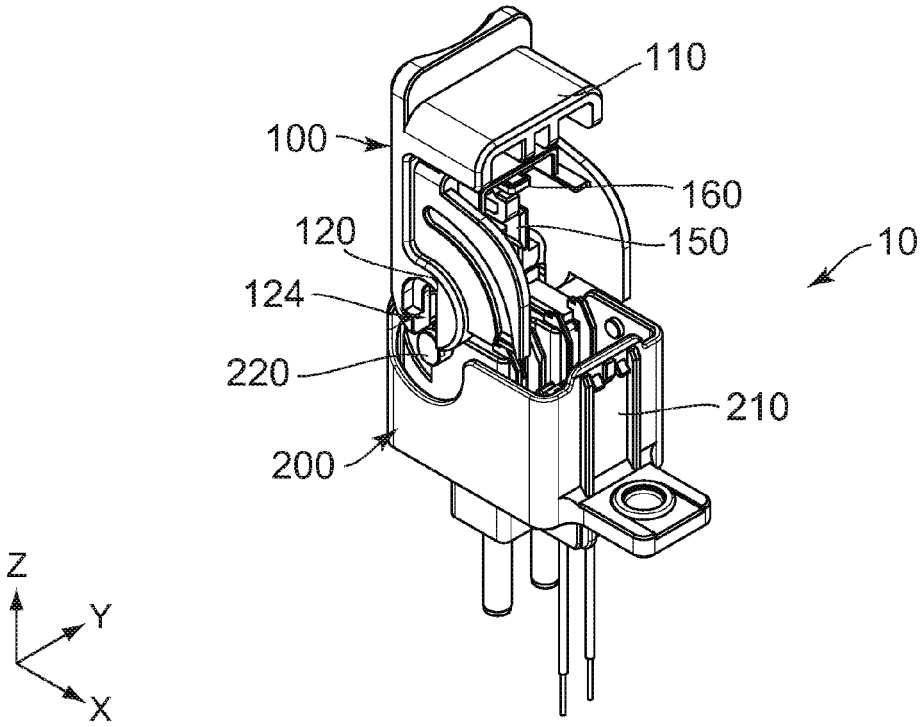
FIG. 1 is a perspective view showing a connector device according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector device 10 according to an embodiment of the present invention comprises a connector 100 and a mating connector 200. The mating connector 200 is attached to an object (not shown) such as an electric car and connected with a power system (not shown) and a motor (not shown). When the connector 100 is mated with the mating connector 200, the connector device 10 connects the power system and the motor with each other so that electric power supplied from the power system is transmitted to the motor.

Figure 4:
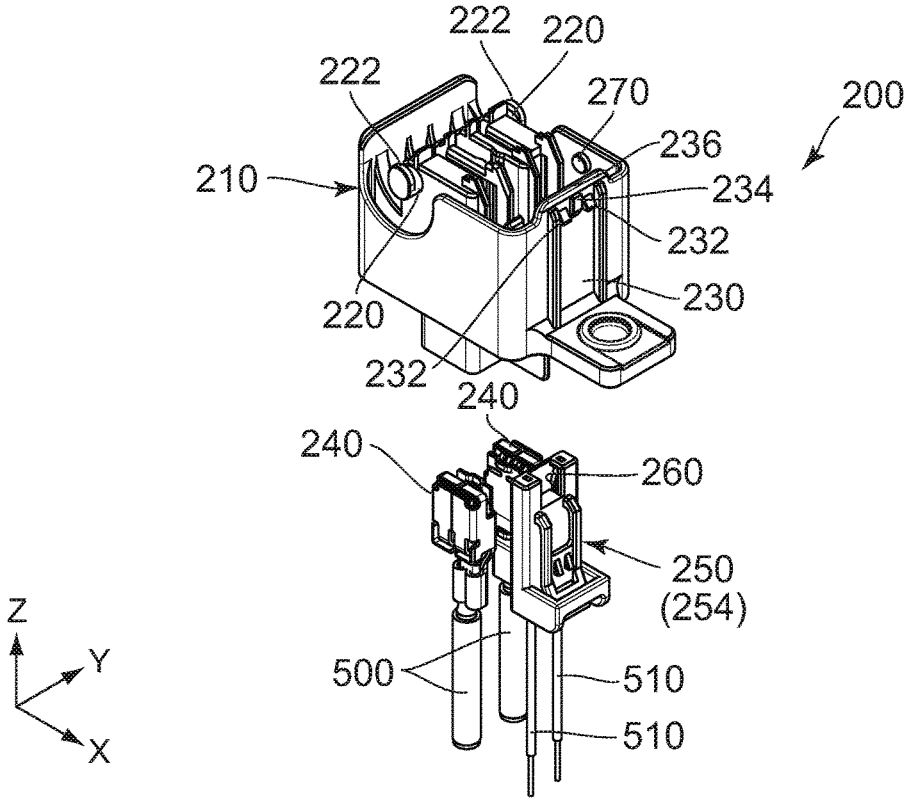
FIG. 4 is an exploded, perspective view showing a mating connector of the connector device of FIG. 1.

As shown in FIG. 4, the mating connector 200 comprises a mating housing 210, two mating power terminals 240 and a mating sub-connector 250.

Referring to FIG. 4, the mating housing 210 is formed with two mating axis portions 220 and two mating guide portions 270. Each of the mating axis portions 220 of the present embodiment is a shaft which projects outward in the Y-direction. As can be seen from this structure, an axial direction of the shaft (mating axis portion 220) in the present embodiment is the Y-direction. The mating axis portions 220 are apart from in the axial direction. Each of the mating axis portions 220 is formed with a flange 222. Each of the flanges 222 is located at an outside end of the corresponding mating axis portion 220 in the axial direction and protrudes in a perpendicular plane perpendicular to the axial direction. The perpendicular plane in the present embodiment is the XZ-plane. Each of the mating guide portions 270 is a projection which projects inward in the axial direction.

As shown in FIG. 4, the mating housing 210 has a wall portion 230. The wall portion 230 is a rear wall which is located at a rear side of the mating housing 210 in a front-rear direction perpendicular to the axial direction. The wall portion 230 extends in an upper-lower direction perpendicular to both the axial direction and the front-rear direction. The front-rear direction in the present embodiment is the X-direction. Therefore, "forward" means the negative X-direction, and "rearward" means the positive X-direction. The upper-lower direction in the present embodiment is the Z-direction. Therefore, "downward" means the negative Z-direction, and "upward" means the positive Z-direction.

Figure 12:
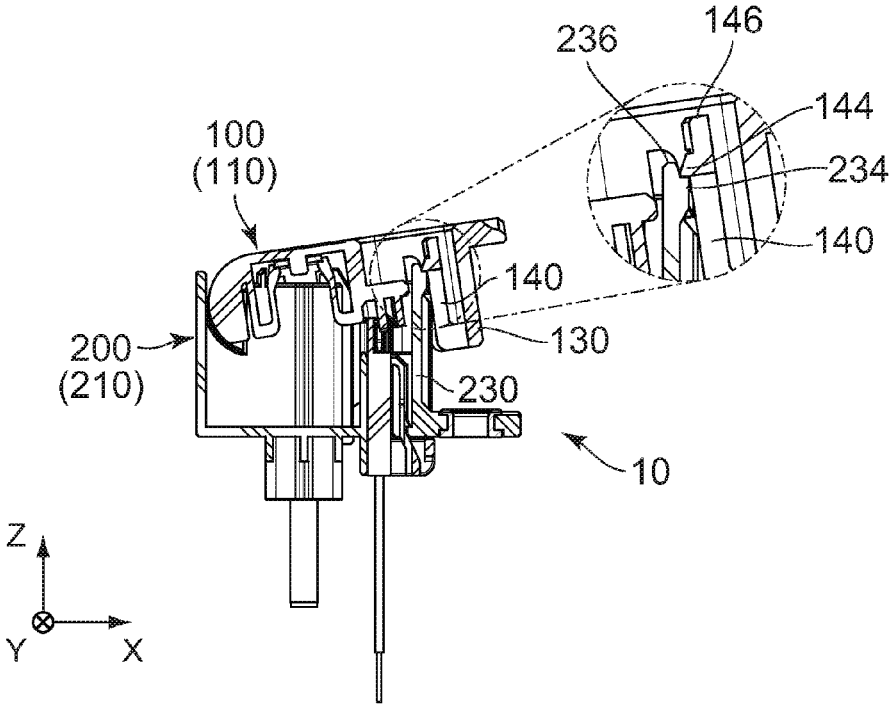
FIG. 12 is a cross-sectional view showing the connector device of FIG. 5, taken along line B-B, wherein the connector is located at the predetermined position.
Figure 13:
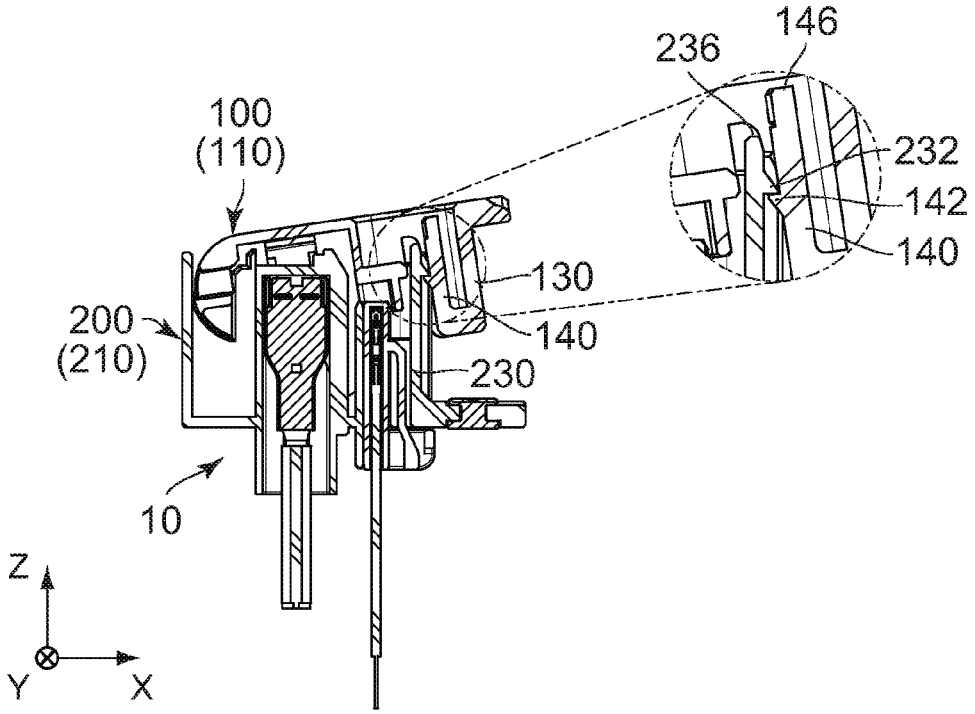
FIG. 13 is a cross-sectional view showing the connector device of FIG. 5, taken along line C-C, wherein the connector is located at the predetermined position.

As shown in FIG. 4, the wall portion 230 of the mating housing 210 is formed with two regulation portions 232, an additional regulation portion 234 and a block portion 236. Each of the regulation portions 232 and the additional regulation portion 234 projects rearward. As shown in FIG. 13, each of the regulation portions 232 has a lower surface perpendicular to the upper-lower direction and an upper surface oblique to the upper-lower direction. As shown in FIG. 12, the additional regulation portion 234 has a lower surface oblique to the upper-lower direction and an upper surface perpendicular to the upper-lower direction. As can be seen from FIG. 4, the block portion 236 is located at an upper end of the wall portion 230 in the upper-lower direction.

Figure 10:
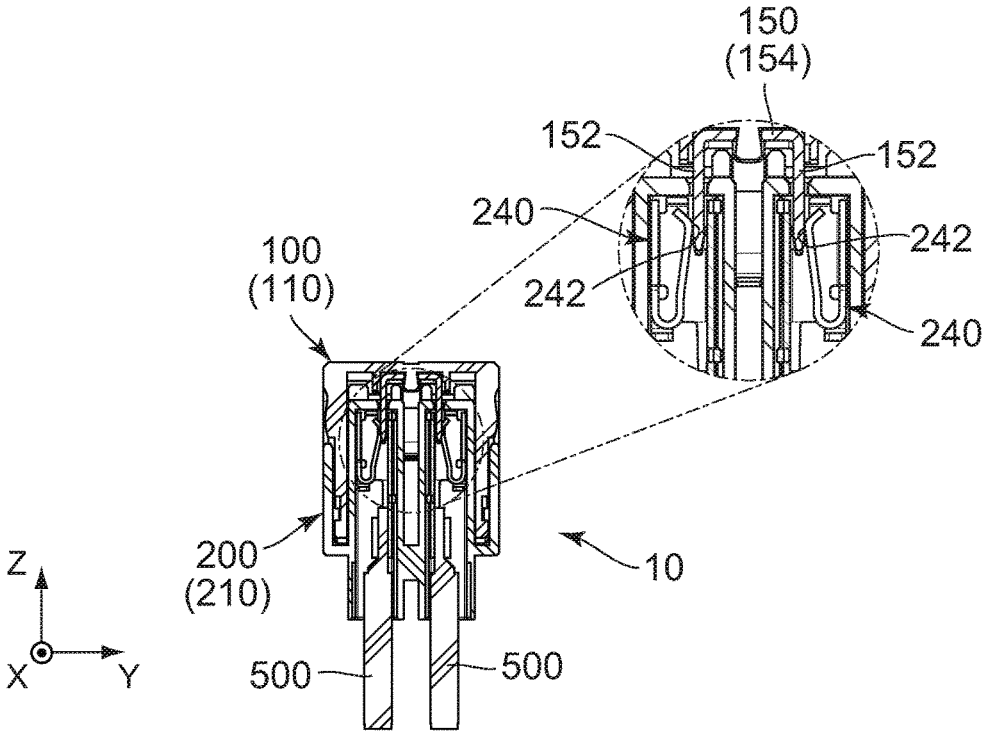
FIG. 10 is a cross-sectional view showing the connector device of FIG. 8, taken along line D-D.
Figure 16:
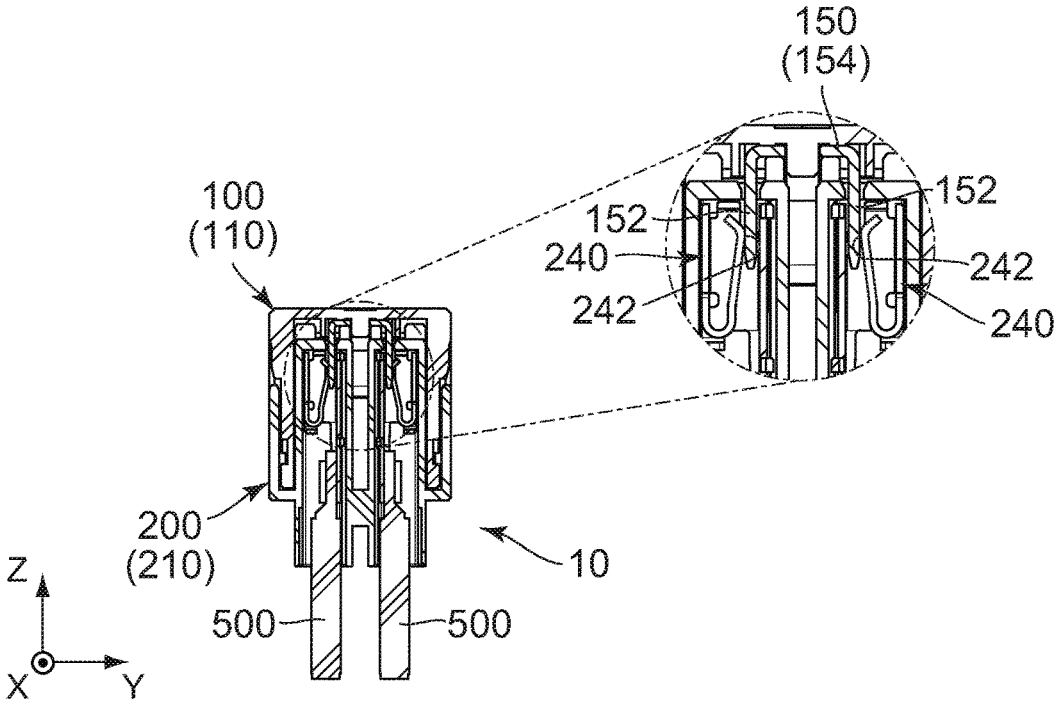
FIG. 16 is a cross-sectional view showing the connector device of FIG. 14, taken along line F-F.

As shown in FIG. 4, each of the mating power terminals 240 is a so-called socket contact. As shown in FIGS. 10 and 16, each of the mating power terminals 240 is provided with a contact point 242. Each of the contact points 242 of the present embodiment is movable at least in the axial direction. As shown in FIG. 4, each of the mating power terminals 240 is connected to a power cable 500. Each of the mating power terminals 240 is held by and fixed to the mating housing 210 and is unmovable relative to the mating housing 210. The mating power terminals 240 are apart from each other in the axial direction.

Figure 11:
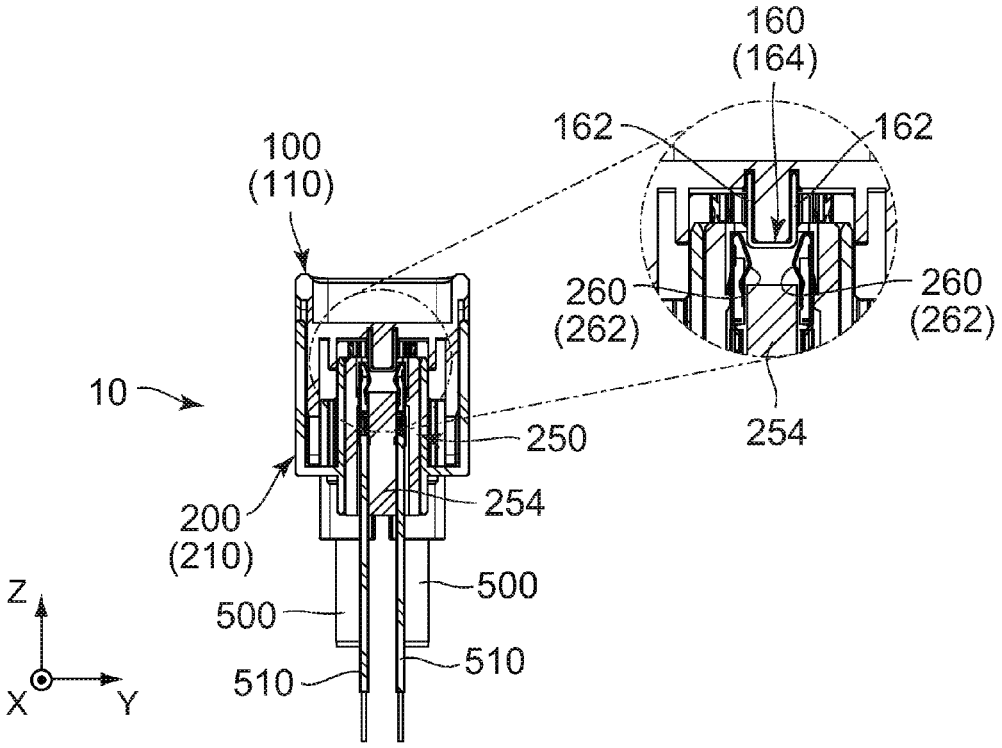
FIG. 11 is a cross-sectional view showing the connector device of FIG. 8, taken along line E-E.
Figure 17:
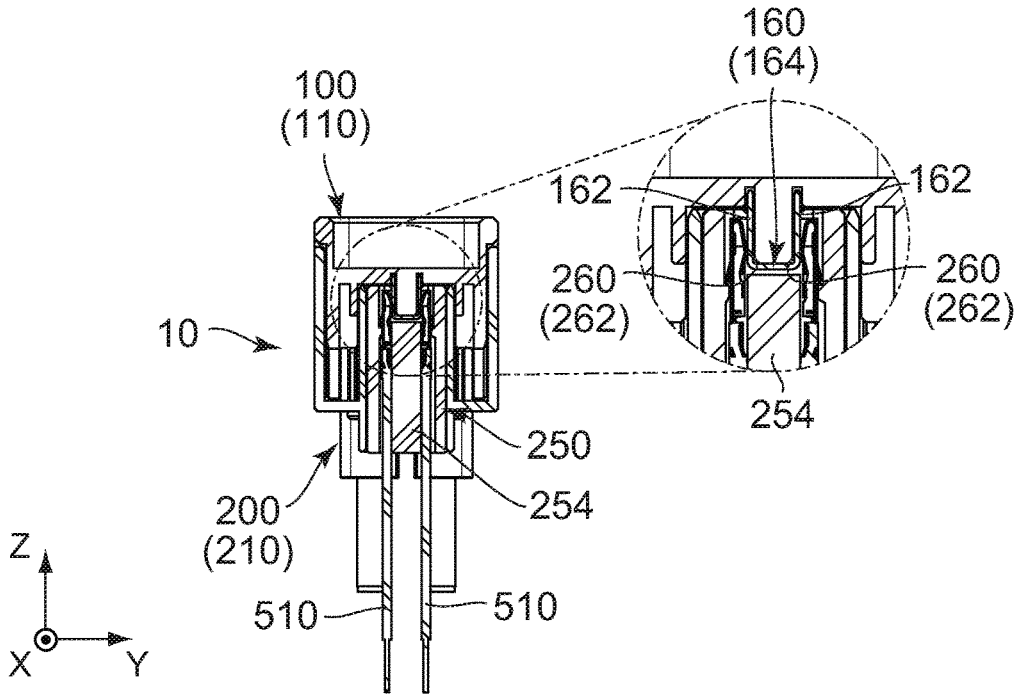
FIG. 17 is a cross-sectional view showing the connector device of FIG. 14, taken along line G-G.

As shown in FIG. 11, the mating sub-connector 250 comprises a sub-housing 254 and two mating detection terminals 260. Each of the mating detection terminals 260 is held by and fixed to the sub-housing 254. The mating sub-connector 250 is held by and fixed to the mating housing 210. Thus, each of the mating detection terminals 260 is held by and fixed to the mating housing 210 via the sub-housing 254 of the mating sub-connector 250 and is unmovable relative to the mating housing 210. The mating detection terminals 260 are apart from each other in the axial direction. Each of the mating detection terminals 260 is connected to a signal cable 510. As shown in FIGS. 11 and 17, each of the mating detection terminals 260 is provided with a contact point 262. Each of the contact points 262 of the present embodiment is movable at least in the axial direction.

Figure 2:
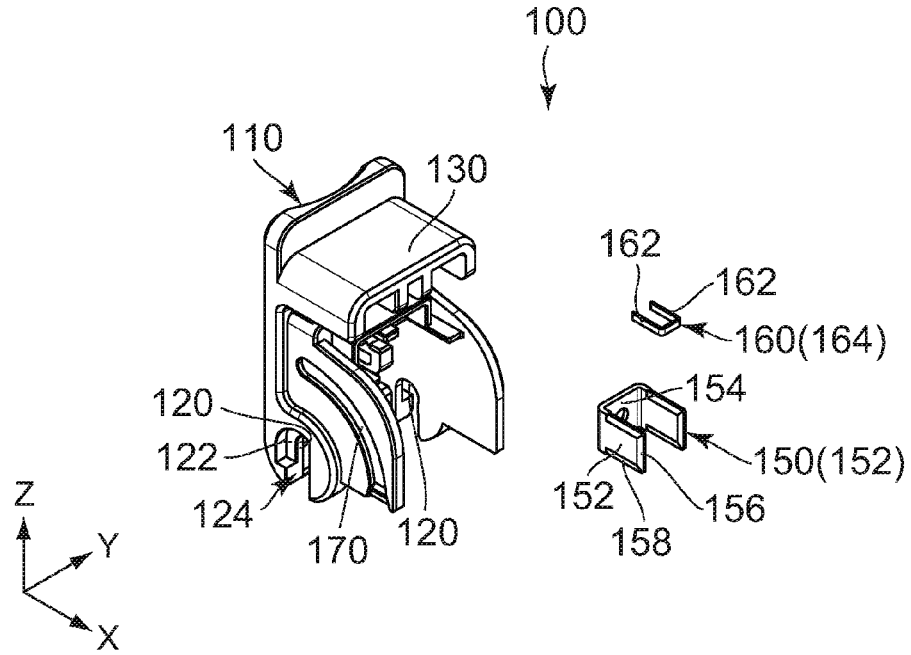
FIG. 2 is an exploded, perspective view showing a connector of the connector device of FIG. 1.

As shown in FIG. 2, the connector 100 comprises a housing 110, a power terminal 150 and a detection terminal 160.

Figure 6:
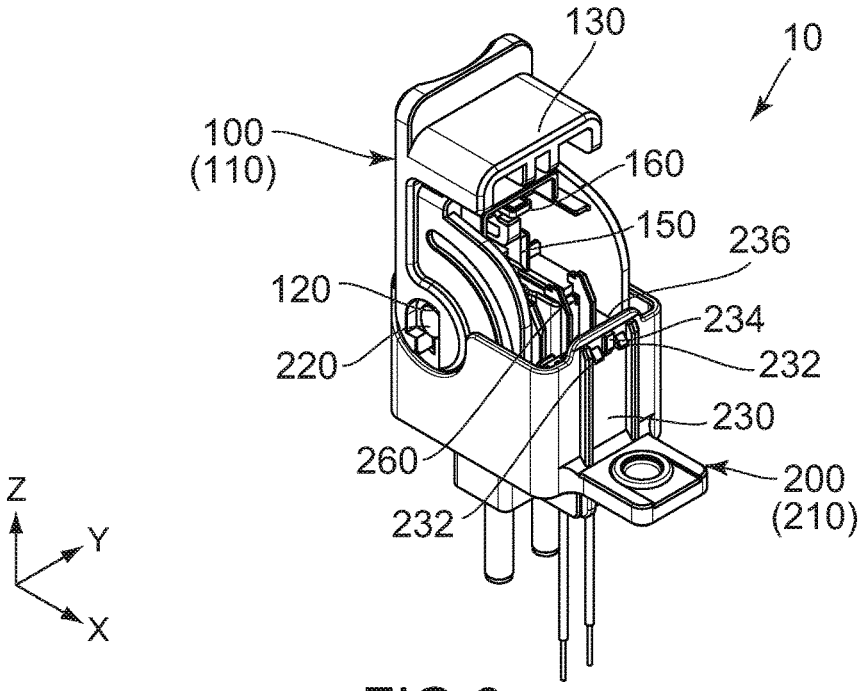
FIG. 6 is a perspective view showing the connector device of FIG. 1, wherein the connector is located at an opened position.
Figure 7:
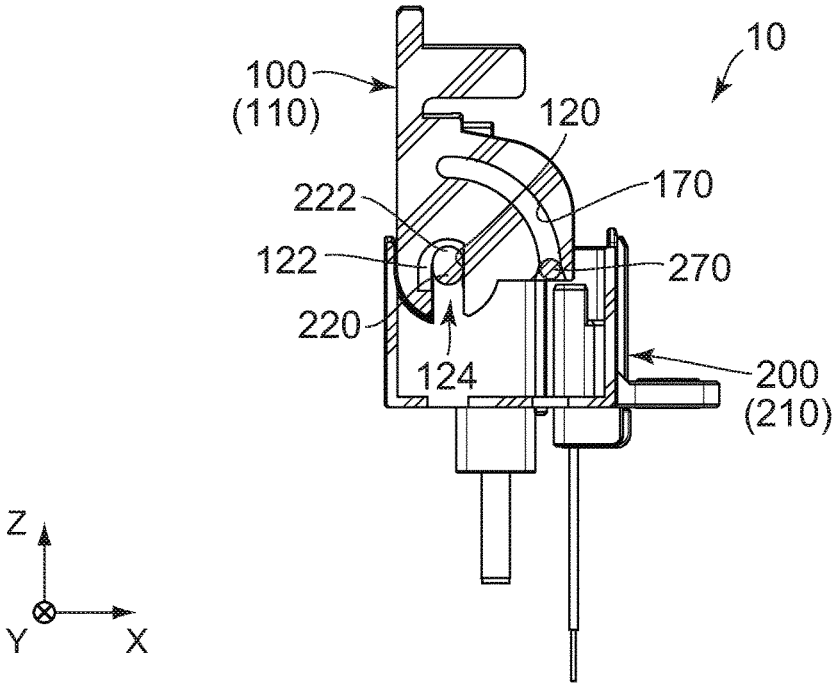
FIG. 7 is a cross-sectional view showing the connector device of FIG. 5, taken along line A-A, wherein the connector is located at the opened position.
Figure 8:
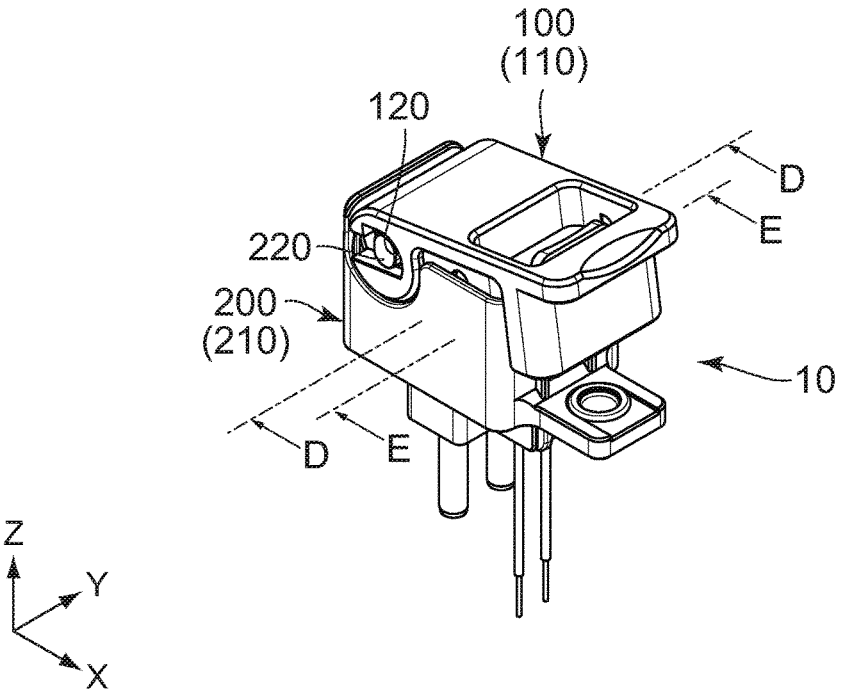
FIG. 8 is a perspective view showing the connector device of FIG. 1, wherein the connector is located at a predetermined position.

Referring to FIGS. 2 and 7, the housing 110 is formed with two axis portions 120, two guide paths 124 and two guide portions 170. Each of the axis portions 120 of the present embodiment is a bearing. The axis portions 120 are apart from each other in the axial direction. Each of the axis portions 120 is formed with a guide face 122. Each of the guide faces 122 extends in the perpendicular plane. The guide paths 124 are provided so as to correspond to the axis portions 120, respectively. As can be seen from FIGS. 1, 6 and 7, each of the guide paths 124 is a channel which guides one of the shafts 220 to the corresponding axis portion 120. Each of the guide paths 124 extends in a radial direction in a circular polar coordinate system on the shaft 220 (hereafter, referred to as "predetermined circular polar coordinate system"). As shown in FIG. 2, each of the guide paths 124 of the present embodiment passes through the housing 110 in the axial direction. Each of the guide portions 170 is a channel which is recessed in the axial direction to have an arc-like shape in the perpendicular plane. Although the guide portion 170 of the present embodiment is the channel with a bottom in the axial direction, the guide portion 170 may have no bottom. In other words, the guide portion 170 may pass through the housing 110 in the axial direction.

Figure 3:
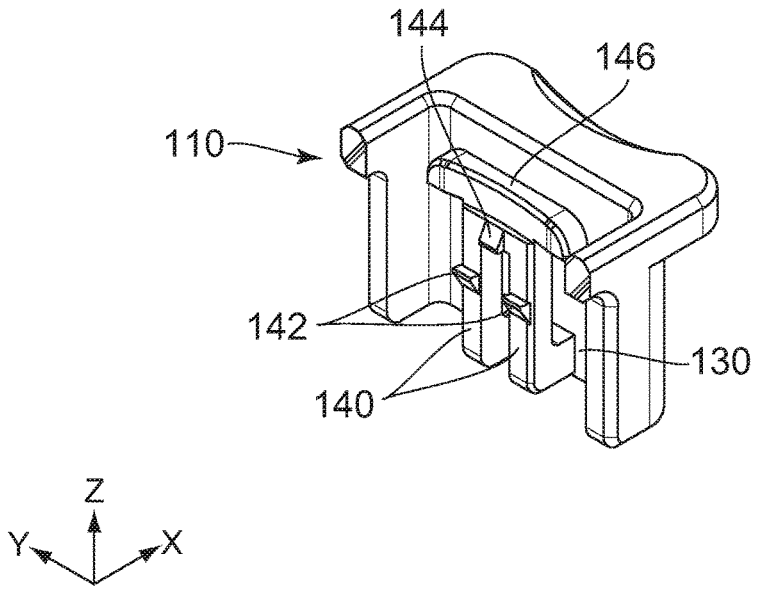
FIG. 3 is a partially cut-away, perspective view showing a housing of the connector of FIG. 2. The illustrated housing is under a state where the connector is located at a closed position.

As can be seen from FIGS. 2 and 3, the housing 110 of the present embodiment is formed with a base portion 130, a spring portion 140, two regulated portions 142, an additional regulated portion 144 and a release portion 146. The spring portion 140 extends from the base portion 130 to have a reversed U-like shape. The spring portion 140 is resiliently deformable. Each of the regulated portions 142 and the additional regulated portion 144 is supported by the spring portion 140. The release portion 146 is provided on an end of the spring portion 140. When the release portion 146 is operated, the spring portion 140 is resiliently deformed so that each of the regulated portions 142 and the additional regulated portion 144 is moved at least in the radial direction in the predetermined circular polar coordinate system.

Figure 5:
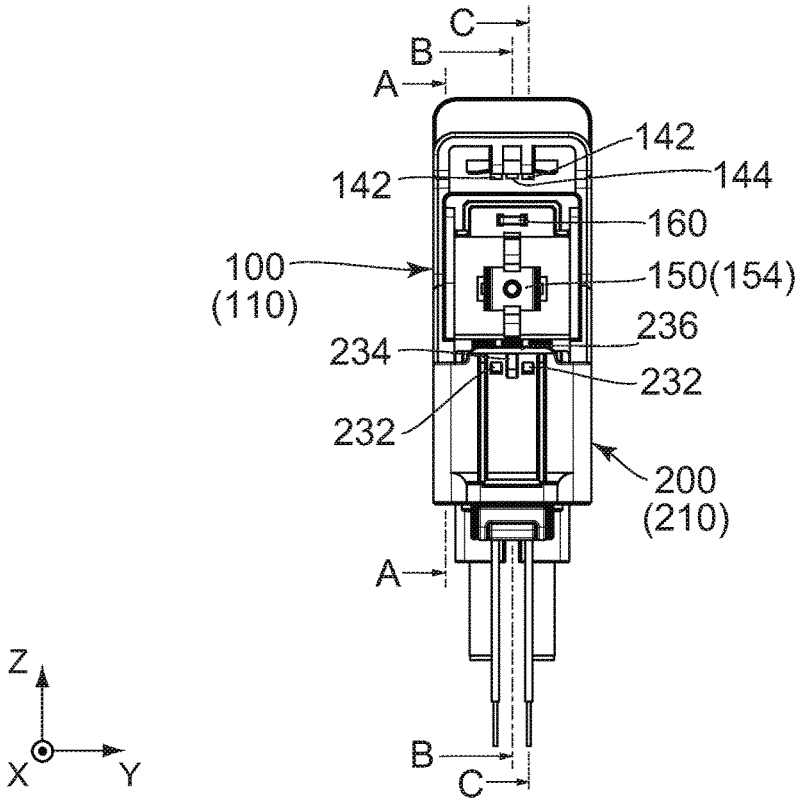
FIG. 5 is a rear view showing the connector device of FIG. 1.

As shown in FIG. 2, the power terminal 150 has two blades 152 and a coupling portion 154 which couples the blades 152 to each other. As shown in FIGS. 10 and 16, the power terminal 150 is a member which connects the two mating power terminals 240 with each other. As shown in FIG. 2, each of the blades 152 extends in the perpendicular plane. Each of the blades 152 is formed with three chamfered edges. Thus, each of the blades 152 has a first chamfered portion 156 and a second chamfered portion 158. As can be seen from FIGS. 2 and 6, the first chamfered portion 156 intersects with at least the circumferential direction in the predetermined circular polar coordinate system, and the second chamfered portion 158 intersects with at least the radial direction in the predetermined circular polar coordinate system. As can be seen from FIGS. 2 and 5, the coupling portion 154 is attached to and held by the housing 110. In particular, the power terminal 150 of the present embodiment is fixed to the housing 110 and is unmovable relative to the housing 110.

As shown in FIG. 2, the detection terminal 160 has two contact portions 162 and a coupling portion 164 which couples the contact portions 162 to each other. As can be seen from FIGS. 2, 5 and 6, the detection terminal 160 is held by the housing 110. Unlike the connector of Patent Document 1, the detection terminal 160 of the present embodiment is fixed to the housing 110 and is unmovable relative to the housing 110.

As can be seen from FIGS. 2 and 6, a distance between the axis portion 120 and the power terminal 150 is shorter than another distance between the axis portion 120 and the detection terminal 160. Because of this structure, the power terminal 150 can be connected to the mating connector 200 before the detection terminal 160 is connected to the mating connector 200 without enlarging the size of the connector device 10.

Figure 14:
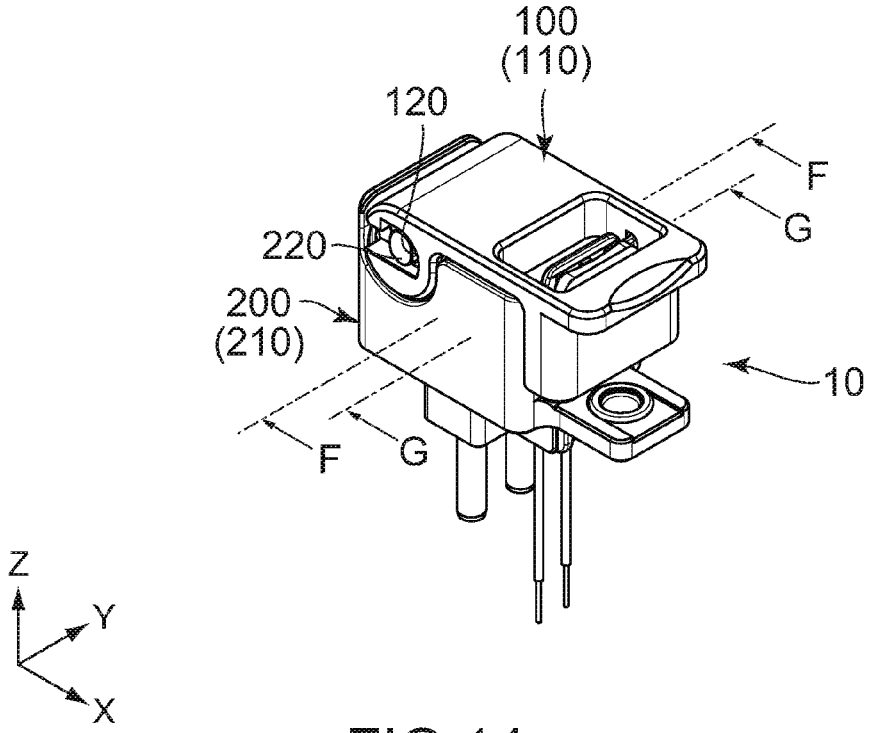
FIG. 14 is a perspective view showing the connector device of FIG. 1, wherein the connector is located at the closed position.
Figure 15:
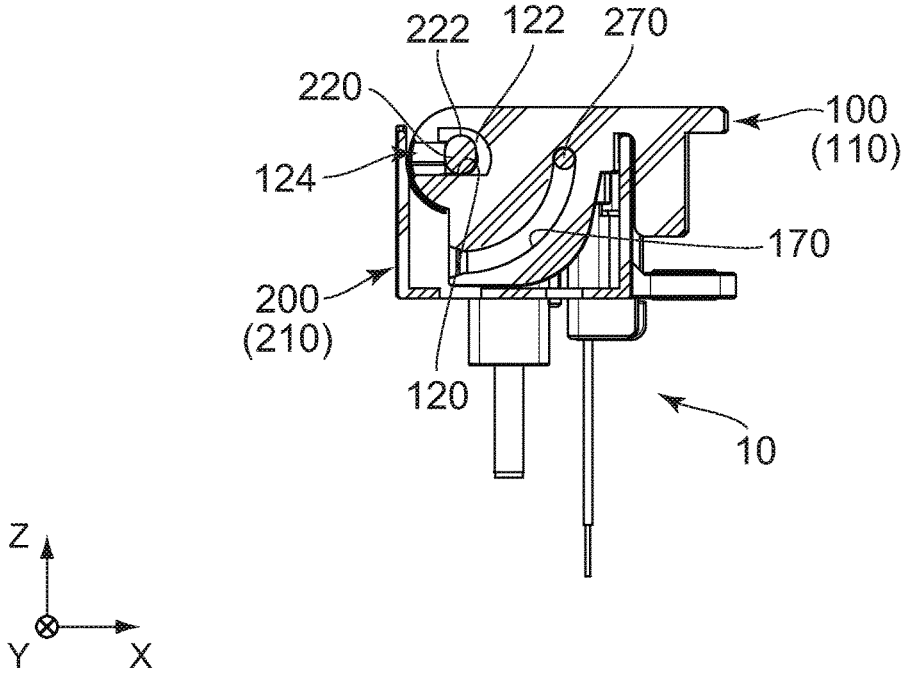
FIG. 15 is a cross-sectional view showing the connector device of FIG. 7, wherein the connector is located at the closed position.

As can be seen from FIGS. 1, 6, 8 and 14, when the axis portions 120 and the mating axis portions 220 are combined with each other, the connector 100 is turnable on the shaft (mating axis portion 220) relative to the mating connector 200 between an opened position and a closed position. The opened position is a position at which the connector 100 stands up as shown in FIG. 6. The closed position is another position at which the connector 100 lies down as shown in FIG. 14. As can be seen from FIGS. 6, 8 and 14, when the connector 100 is located between the opened position and the closed position, the connector 100 is located upward of the mating connector 200 in the upper-lower direction.

As can be seen from FIGS. 2, 4, 7, 9 and 15, when the connector 100 is turned between the opened position and the closed position, the guide faces 122 are located inward of the flanges 222 in the axial direction, respectively. In the meantime, each of the guide faces 122 faces the corresponding flange 222 in the axial direction to guide a movement of the corresponding flange 222 in the perpendicular plane. Moreover, when the connector 100 is turned, the projections of the mating guide portions 270 are moved in the channels of the guide portions 170, respectively, to guide the turn of the connector 100.

As can be seen from FIGS. 1, 6 and 7, in an attachment process of the connector 100 to the mating connector 200, the connector 100 is moved along the upper-lower direction after placed above the mating connector 200 under a state where the connector 100 stands up, or where a longitudinal direction of the connector 100 extends in parallel to the upper-lower direction. During this attachment process, each of the guide paths 124 receives the corresponding mating axis portion 220 and guides the corresponding mating axis portion 220 to the corresponding axis portion 120 along the upper-lower direction. As shown in FIG. 7, when the thus-attached connector 100 is located at the opened position, each of the guide paths 124 extends along the upper-lower direction and opens downward. As can be seen from FIGS. 4 and 6, when the connector 100 is located at the opened position, the power terminal 150 is unconnected to the mating power terminals 240, and the detection terminal 160 is unconnected to the mating detection terminals 260.

As shown in FIG. 12, when the connector 100 is turned from the opened position to predetermined position which is located between the opened position and the closed position, the additional regulated portion 144 is brought into abutment with the additional regulation portion 234 so that the additional regulation portion 234 temporarily regulates a movement of the connector 100 toward the closed position beyond the predetermined position. As shown in FIGS. 10 and 11, at that time, the power terminal 150 is connected to the mating power terminals 240, but the detection terminal 160 is not yet moved to the mating detection terminals 260. Thus, as shown in FIGS. 8 to 11, when the connector 100 is located at the predetermined position, the power terminal 150 is connected to the mating power terminals 240, but the detection terminal 160 is unconnected to the mating detection terminals 260. Since the detection terminal 160 is unconnected to the mating detection terminals 260, the signal cables 510 are unconnected with each other. Because of this disconnection between the signal cables 510, the power system (not shown) can detect that the connector 100 is not completely mated with the mating connector 200. Therefore, the power system can make control so that the electric current does not flow through the power cables 500 even under a state where the power terminal 150 physically connects the mating power terminals 240 to each other.

Figure 9:
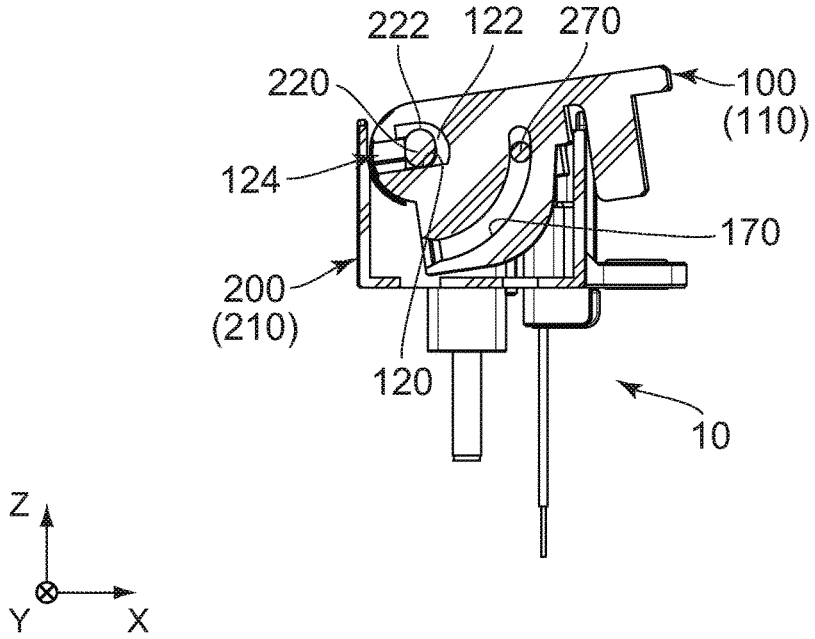
FIG. 9 is a cross-sectional view showing the connector device of FIG. 7, wherein the connector is located at the predetermined position.

As can be seen from FIGS. 2 and 10, each of the blades 152 of the power terminal 150 is moved in the perpendicular plane while the connector 100 is turned. Referring to FIGS. 9 and 10, since the guide faces 122 guide the flanges 222, respectively, each of the blades 152 can be properly moved in the perpendicular plane and can be moved into the inside of the corresponding mating power terminal 240.

As previously described, each of the blades 152 is formed with not only the first chamfered portion 156 but also the second chamfered portion 158. Because of this structure, when the blades 152 are connected to the mating power terminals 240, respectively, the blades 152 are smoothly received into the mating power terminals 240, respectively. In the present embodiment, each of the thus-received blades 152 of the power terminal 150 is located in the corresponding mating power terminal 240 and is in contact with the contact point 242 of the corresponding mating power terminal 240 in the axial direction.

Referring to FIG. 12, as described above, when the connector 100 is located at the predetermined position, the additional regulated portion 144 is in abutment with the additional regulation portion 234 so that the movement of the connector 100 is temporarily regulated. When the connector 100 under this state receives a force which is larger than another force due to the regulation of the additional regulation portion 234 and which urges the connector 100 to be turned toward the closed position, the spring portion 140 is resiliently deformed so that the additional regulated portion 144 is moved outward in the radial direction of the turn of the connector 100. As a result, the aforementioned regulation is released, so that the connector 100 can be moved to the closed position as shown in FIG. 14.

As shown in FIGS. 14 to 17, when the connector 100 is located at the closed position, the power terminal 150 is connected to the mating power terminals 240, and the detection terminal 160 is connected to the mating detection terminals 260. Because of this connection, the power system (not shown) can detect that the connector 100 is completely mated with the mating connector 200. Therefore, the power system can make control so that the electric current flows through the power cables 500.

In the present embodiment, when the connector 100 is located between the predetermined position and the closed position, the power terminal 150 is kept to be in contact with the mating power terminals 240 in the axial direction. As can be seen from FIGS. 2 and 16, when the connector 100 is located at the closed position, the first chamfered portion 156 intersects with the upper-lower direction, and the second chamfered portion 158 intersects with the front-rear direction. As shown in FIG. 16, when the connector 100 is located at the closed position, the power terminal 150 has a cross-section of an angular, reversed U-like shape in a plane perpendicular to the front-rear direction, or in the YZ-plane.

As can be seen from FIGS. 11 and 17, the detection terminal 160 is unconnected to the mating detection terminals 260 before the connector 100 is moved to the closed position. The detection terminal 160 is connected to the contact points 262 of the mating detection terminals 260 at the time when the connector 100 is moved to the closed position. As shown in FIG. 17, when the connector 100 is located at the closed position, the detection terminal 160 has a cross-section of an angular U-like shape in a plane perpendicular to the front-rear direction, or in the YZ-plane.

Figure 18:
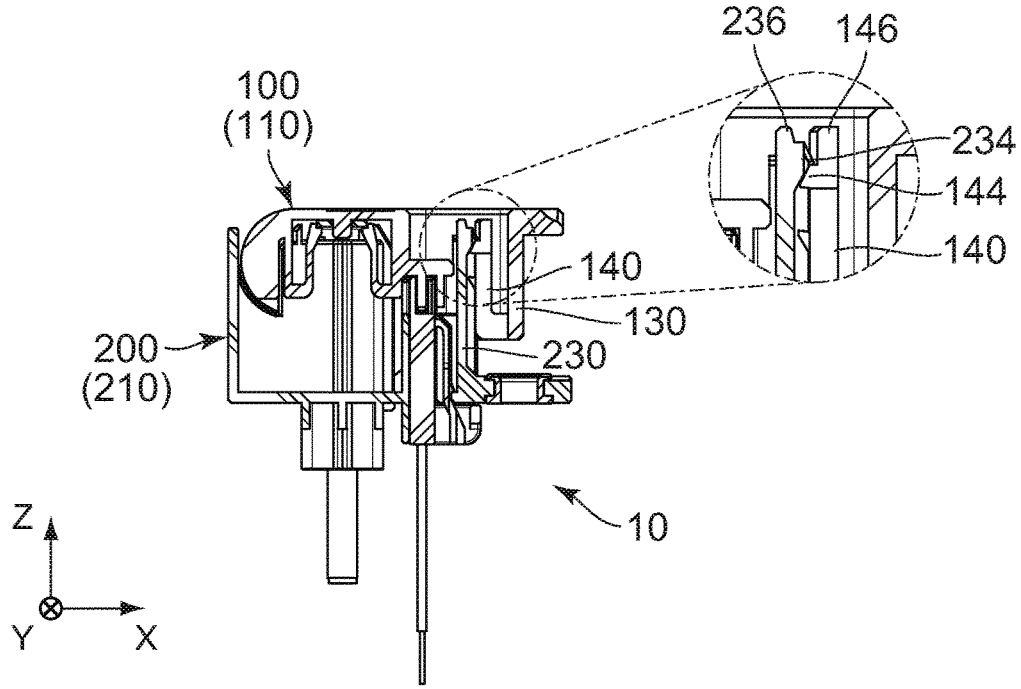
FIG. 18 is a cross-sectional view showing the connector device of FIG. 12, wherein the connector is located at the closed position.
Figure 19:
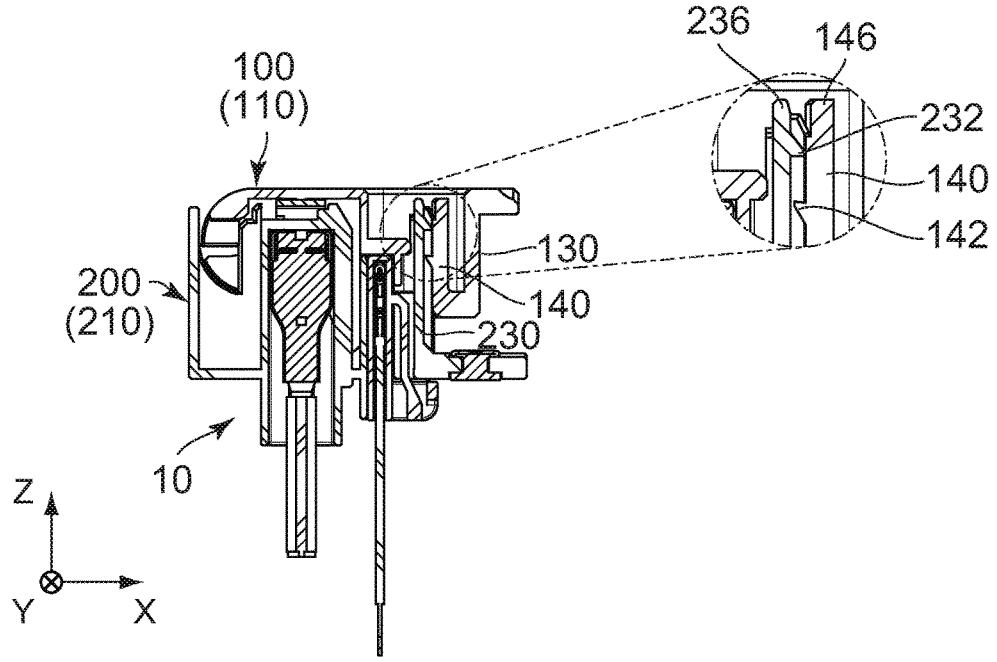
FIG. 19 is a cross-sectional view showing the connector device of FIG. 13, wherein the connector is located at the closed position.
Figure 20:
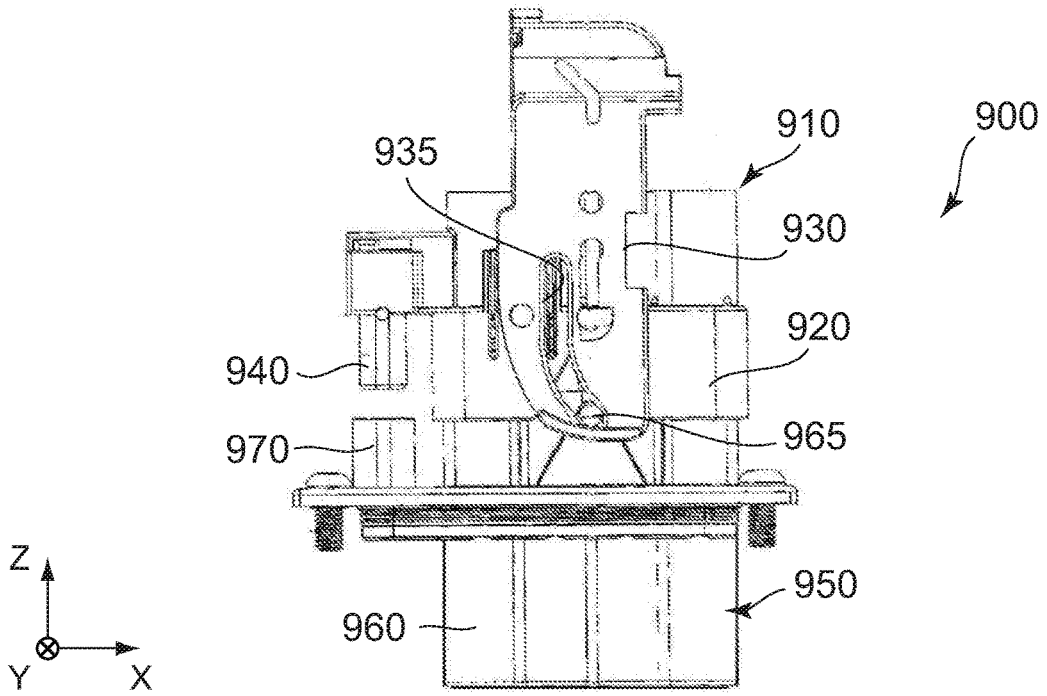
FIG.20 PRIOR ART
FIG. 20 is a side view showing a connector device of Patent Document 1.

As shown in FIGS. 18 and 19, when the connector 100 is located at the closed position, the spring portion 140 extends upward from the base portion 130, and the release portion 146 is located at an upper end of the spring portion 140. In the meantime, the block portion 236 is located at a position same as that of the release portion 146 in the upper-lower direction. The block portion 236 is located inward of the release portion 146 in the radial direction to block an operation of the release portion 146.

In a turning operation of the connector 100 from the closed position to the opened position, the connector 100 is first turned from the closed position to the predetermined position as shown in FIG. 13. As can be seen from FIG. 13, when the connector 100 is turned from the closed position to the predetermined position, the regulated portions 142 are brought into abutment with the regulation portions 232, respectively, so that the regulation portions 232 regulate a movement of the connector 100 toward the opened position beyond the predetermined position. At that time, the base of the spring portion 140, or the boundary portion between the spring portion 140 and the base portion 130, is located below the regulated portions 142, and the release portion 146 is located at an upper side of the spring portion 140. Because of this arrangement, even if the connector 100 is forced to be turned toward the opened position, the regulated portions 142 are further caught by the regulation portions 232, respectively, so that the regulation can be prevented from being undesirably released.

As shown in FIG. 13, when the connector 100 is located at the predetermined position, the release portion 146 is apart from the block portion 236 in the circumferential direction of the turn of the connector 100. The thus-located release portion 146 is operable without being blocked by the block portion 236. As can be seen from FIG. 13, when the release portion 146 is moved outward in the radial direction of the turn of the connector 100, the spring portion 140 is resiliently deformed, and the regulation of the regulated portions 142 by the regulation portions 232 is released. As a result, the connector 100 can be further turned toward the opened position. The outward direction in the radial direction of the turn of the connector 100 can be resolved into two components, namely the rearward component in the front-rear direction and the upward component in the upper-lower direction. As can be seen from FIGS. 7, 9, 13 and 15, in the present embodiment, the predetermined position is rather nearer to the closed position than the opened position. Because of this arrangement, when the connector 100 is located at the predetermined position, the rearward component is rather larger than the upward component. Therefore, when the release portion 146 illustrated in FIG. 13 is operated to be moved rearward, the regulation can be released. This release allows the connector 100 to be turned to the opened position beyond the predetermined position.

While there has been described about specific embodiment of the present invention, the present invention is not limited thereto but can be variously modified.

In the aforementioned embodiment, the axis portion 120 is the bearing, and the mating axis portion 220 is the shaft. However, the present invention is not limited thereto. The axis portion 120 may be the shaft, and the mating axis portion 220 may be the bearing.

In the aforementioned embodiment, the guide portion 170 is the arc-like shaped channel, and the mating guide portion 270 is the projection. However, the present invention is not limited thereto. The guide portion 170 may be the projection, and the mating guide portion 270 may be the channel.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector device which comprises a connector and a mating connector which are mateable with each other, wherein:

the connector comprises a housing, a power terminal and a detection terminal;

the housing is formed with a bearing portion;

the power terminal and the detection terminal are held by the housing;

the mating connector comprises a mating housing, a mating power terminal and a mating detection terminal;

the mating housing is formed with a shaft portion;

when the bearing portion and the shaft portion are combined with each other, the connector is turnable on the shaft portion relative to the mating connector between an opened position and a closed position;

the mating power terminal and the mating detection terminal are held by the mating housing;

when the connector is located between the opened position and the closed position, the connector is located upward of the mating connector in an upper-lower direction perpendicular to an axial direction of the shaft portion;

when the connector is located at the opened position, the power terminal is unconnected to the mating power terminal, and the detection terminal is unconnected to the mating detection terminal;

when the connector is located at a predetermined position between the opened position and the closed position, the power terminal is connected to the mating power terminal, but the detection terminal is unconnected to the mating detection terminal; and when the connector is located at the closed position, the power terminal is connected to the mating power terminal, and the detection terminal is connected to the mating detection terminal.

2. The connector device as recited in claim 1, wherein:

each of the power terminal and the detection terminal is fixed to the housing and is unmovable relative to the housing; and each of the mating power terminal and the mating detection terminal is fixed to the mating housing and is unmovable relative to the mating housing.

3. The connector device as recited in claim 1, wherein a distance between the bearing portion and the power terminal is shorter than another distance between the bearing portion and the detection terminal.

4. The connector device as recited in claim 1, wherein:

the housing is provided with a guide portion;

the mating housing is formed with a mating guide portion;

one of the guide portion and the mating guide portion is a projection, and a remaining one of the guide portion and the mating guide portion is a channel which has an arc-like shape; and when the connector is turned, the projection is moved in the channel to guide a turn of the connector.

5. The connector device as recited in claim 1, wherein:

the housing is formed with a guide path which guides the shaft portion to the bearing portion; and when the connector is located at the opened position, the guide path extends along the upper-lower direction and opens downward.

6. The connector device as recited in claim 1, wherein when the connector is located between the predetermined position and the closed position, the power terminal is in contact with the mating power terminal in the axial direction.

7. The connector device as recited in claim 6, wherein:

the shaft portion is formed with a flange which protrudes in a perpendicular plane perpendicular to the axial direction;

the bearing portion is formed with a guide face which extends in the perpendicular plane; and when the connector is turned between the opened position and the closed position, the guide face guides a movement of the flange in the perpendicular plane.

8. The connector device as recited in claim 6, wherein:

the power terminal has a blade which extends in a perpendicular plane perpendicular to the axial direction;

the blade has a first chamfered portion and a second chamfered portion; and when the connector is located at the closed position, the first chamfered portion intersects with the upper-lower direction, and the second chamfered portion intersects with a front-rear direction perpendicular to both the upper-lower direction and the axial direction.

9. The connector device as recited in claim 1, wherein:

the housing is formed with a regulated portion;

the mating housing is formed with a regulation portion; and when the connector is turned from the closed position to the predetermined position, the regulated portion is brought into abutment with the regulation portion so that the regulation portion regulates a movement of the connector toward the opened position beyond the predetermined position.

10. The connector device as recited in claim 9, wherein:

the housing is formed with an additional regulated portion;

the mating housing is formed with an additional regulation portion; and when the connector is turned from the opened position to the predetermined position, the additional regulated portion is brought into abutment with the additional regulation portion so that the additional regulation portion regulates a movement of the connector toward the closed position beyond the predetermined position.

11. The connector device as recited in claim 9, wherein:

the housing is provided with a base portion and a spring portion which is resiliently deformable;

the regulated portion is supported by the spring portion;

the spring portion is provided with a release portion;

when the connector is located at the closed position, the spring portion extends upward from the base portion, and the release portion is located at an upper end of the spring portion; and when the release portion is moved outward in a radial direction of a turn of the connector, the spring portion is resiliently deformed, and a regulation of the regulated portion by the regulation portion is released.

12. The connector device as recited in claim 11, wherein:

the mating housing is provided with a block portion;

when the connector is located at the closed position, the block portion is located inward of the release portion in the radial direction to block an operation of the release portion; and when the connector is located at the predetermined position, the release portion is apart from the block portion in a circumferential direction of the turn of the connector and is operable without being blocked by the block portion.

13. The connector device as recited in claim 12, wherein:

the mating housing has a wall portion which extends in the upper-lower direction;

each of the regulation portion and the block portion is provided on the wall portion;

the block portion is located at an upper end of the wall portion; and when the connector is located at the closed position, the block portion is located at a position same as that of the release portion in the upper-lower direction.

* * * * *